US008449700B2

(12) United States Patent
Senuma et al.

(10) Patent No.: US 8,449,700 B2
(45) Date of Patent: May 28, 2013

(54) MANUFACTURING METHOD OF A HOT-PRESSED STEEL PLATE MEMBER

(75) Inventors: Takehide Senuma, Okayama (JP); Hiroshi Yoshida, Okayama (JP)

(73) Assignee: National University Corporation Okayama University, Okayama-shi (JP)

( * ) Notice: Subject to any disclaimer, the term of this patent is extended or adjusted under 35 U.S.C. 154(b) by 49 days.

(21) Appl. No.: 13/119,804

(22) PCT Filed: Sep. 17, 2009

(86) PCT No.: PCT/JP2009/066227

§ 371 (c)(1), (2), (4) Date: Jun. 8, 2011

(87) PCT Pub. No.: WO2010/032776

PCT Pub. Date: Mar. 25, 2010

(65) Prior Publication Data

US 2011/0226393 A1 Sep. 22, 2011

(30) Foreign Application Priority Data

Sep. 18, 2008 (JP) ..... 2008-239573

(51) Int. Cl.
*C21D 8/02* (2006.01)

(52) U.S. Cl.
USPC ..... 148/652; 148/649; 148/651; 148/654

(58) Field of Classification Search
USPC ..... 148/320, 332–337, 645, 648–652, 148/654
See application file for complete search history.

(56) References Cited

U.S. PATENT DOCUMENTS

| | | | |
|---|---|---|---|
| 2003/0005986 | A1 | 1/2003 | Hasegawa et al. |
| 2009/0277547 | A1 | 11/2009 | Saito et al. |

FOREIGN PATENT DOCUMENTS

| | | |
|---|---|---|
| JP | 2005-240072 | 9/2005 |
| JP | 2005-262235 | 9/2005 |
| JP | 3729108 | 10/2005 |
| JP | 2006-70346 | 3/2006 |
| JP | 2008-38247 | 2/2008 |

OTHER PUBLICATIONS

Machine-English translated Japanese patent No. 2006-152427, Nishihata Toshinobu, Jun. 15, 2006.*
International Search Report issued Dec. 22, 2009, in Application No. PCT/JP2009/0066227.

* cited by examiner

*Primary Examiner* — Deborah Yee
(74) *Attorney, Agent, or Firm* — Oblon, Spivak, McClelland, Maier & Neustadt, L.L.P.

(57) ABSTRACT

Disclosed are a high-strength, high-toughness hot-pressed steel plate member and a manufacturing method therefor. A specified hot-press process is performed on a steel plate member that, with respect to the chemical composition of the steel plate, includes: 0.15 to 0.4 wt % of C; 1.0 to 5.0 wt % of Mn or of a total of Mn and at least one of Cr, Mo, Cu, and Ni; 0.02 to 2.0 wt % of at least any one of Si and Al; and the remainder being Fe and unavoidable impurities, thus providing the physical properties of a martensite phase average grain diameter of 5 μm or less and a tensile strength of 1200 MPa or higher.

3 Claims, 1 Drawing Sheet

MANUFACTURING METHOD OF A HOT-PRESSED STEEL PLATE MEMBER

TECHNICAL FIELD

The present invention relates to a hot-pressed steel plate member having a fine structure of martensite and a manufacturing method therefor.

BACKGROUND ART

A large number of steel plate members are used in a car. Car weight is reduced in various manners to improve fuel consumption. The steel plate members are also targets of weight saving. That is, weight saving is required by reducing the thickness of the steel plate members and increasing strength.

The steel plate members used in a car are used for members for protecting passengers at the time of impact such as door impact beams or center pillar reinforcement.

Accordingly, such a steel plate member needs to surely maintain a predetermined strength.

In particular, when a steel plate member having a high strength used in a car is manufactured by using a hot stamping technology, the steel plate member is heated to a transformation point or higher, subjected to press forming by using a mold in the austenite area, and heat is extracted by a mold for martensite transformation in a general hot stamping technology.

It has been known that a steel plate member formed into a predetermined shape by using the hot stamping technology has a low toughness value since it remains to have a hardened structure.

Therefore, annealing process may be performed on the steel plate member or steel material after the processing by means of the hot stamping technology to improve the toughness value.

Furthermore, there have been proposed a high tension cold-rolled steel plate having a martensite single-phase structure and a tensile strength of 880 to 1170 MPa by appropriately setting the structure and heat treatment conditions of the steel material (for example, see Patent Document 1) and a high-strength steel having an average grain diameter of 10 μm or less in the martensite phase whose space factor is 80% or higher and having a tensile strength of 780 MPa or higher (for example, see Patent Document 2).

Patent Document 1: Japanese Patent No. 3729108

Patent Document 2: Japanese Patent Application Publication No. 2008-038247

SUMMARY OF THE INVENTION

Problems to be Solved

However, in the high tension cold-rolled steel plate having a martensite single-phase structure and the high-strength steel having an average grain diameter of 10 μm or less in the martensite phase whose space factor is 80% or higher, it has been difficult to provide an average grain diameter of 5 μm or less and it has been difficult to ensure toughness with a steel material whose tensile strength exceeds 1200 MPa as Examples show limitations.

The present inventors conducted research and development in order to provide a steel plate member having a high strength and high toughness by further reducing the martensite phase average grain diameter in the light of such a situation, and have achieved the invention.

Means for Solving Problems

A hot-pressed steel plate member of the invention contains, with respect to the chemical composition of a steel plate, 0.15 to 0.4 wt % of C, 1.0 to 5.0 wt % of Mn or of a total of Mn and at least one of Cr, Mo, Cu, and Ni, 0.02 to 2.0 wt % of at least any one of Si and Al, and the remainder being Fe and unavoidable impurities, and provides physical properties of a martensite phase average grain diameter of 5 μm or less and a tensile strength of 1200 MPa or higher, which is provided by being subjected to specific hot pressing.

Furthermore, the hot-pressed steel plate member of the invention is characterized by containing 0.1 wt % or less of at least one of B, Ti, Nb, and Zr, and also characterized by including a plating film having a thickness of 0.1 to 20 μm on a surface.

Furthermore, a manufacturing method of a hot-pressed steel plate member of the invention uses a raw steel plate containing, with respect to the chemical composition of the steel plate, 0.15 to 0.4 wt % of C, 1.0 to 5.0 wt % of Mn or of a total of Mn and at least one of Cr, Mo, Cu, and Ni, 0.02 to 2.0 wt % of at least any one of Si and Al, and the remainder being Fe and unavoidable impurities, and providing physical properties of a martensite phase average grain diameter of 5 μm or less and a tensile strength of 1200 MPa or higher, which is provided by subjecting the raw steel plate to hot pressing. The hot pressing includes a heating process for heating the steel plate member to a highest heating temperature T° C. of 675 to 950° C. at a rate of temperature increase of 10° C./sec or higher, a temperature keeping process for keeping the highest heating temperature T° C. for (40-T/25) sec or less, and a cooling process for cooling the steel plate member to not more than an Ms point that is a temperature of formation of the martensite phase at a cooling rate of 1.0° C./sec or higher from the highest heating temperature T° C. while pressing the steel plate member.

Furthermore, the manufacturing method of a hot-pressed steel plate member of the invention is characterized in that the steel plate member contains 0.1 wt % or less of at least one of B, Ti, Nb, and Zr, press working for forming the steel plate member to have a predetermined shape is performed once or more before reaching the Ms point in the cooling process, and the steel plate member is subjected to cold rolling at a reduction of 30% or higher before the heating process.

Advantageous Effects of Invention

According to the invention, the martensite phase average grain diameter can be 5 μm or less, so that a high strength steel plate member whose tensile strength is 1200 MPa or higher can be provided while improving its toughness.

BEST MODE(S) FOR CARRYING OUT THE INVENTION

Figure 1:
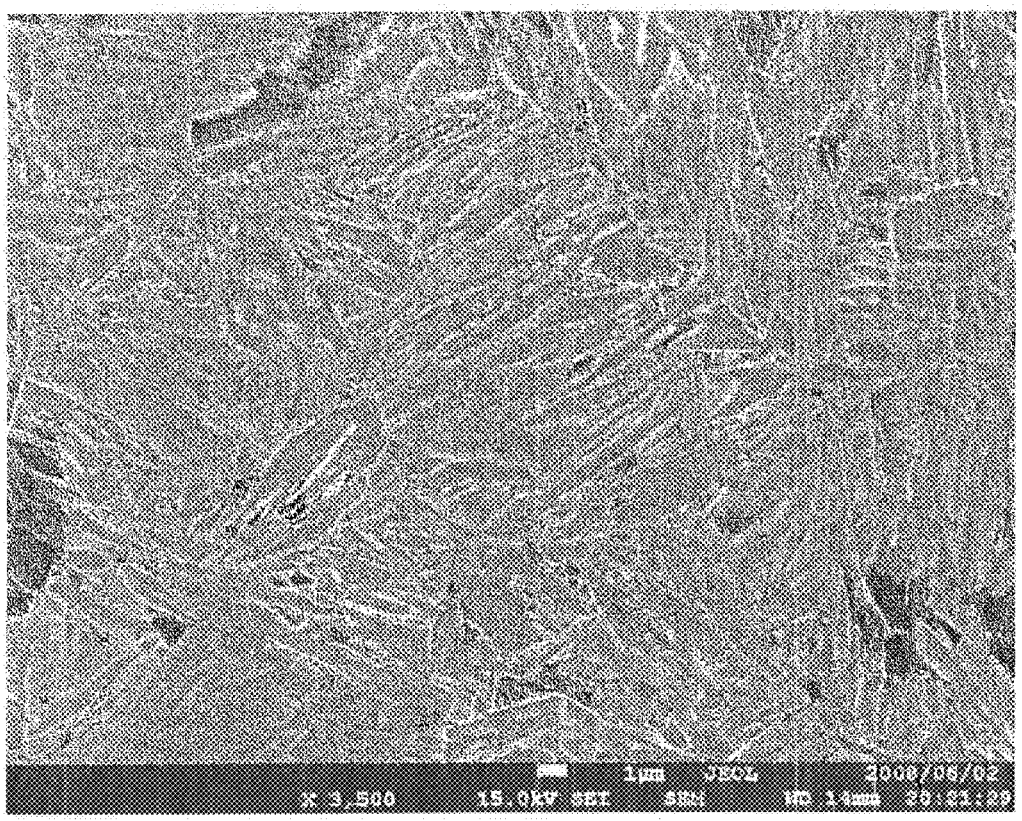
FIG. 1 is an SEM photo image taking a martensite phase of a steel plate member of Experiment No. 6.

In a hot-pressed steel plate member and a manufacturing method therefor of the present invention, the average grain diameter of a metal structure of the steel plate member, especially of martensite phase, is reduced to 5 μm or less to thereby provide high strength while improving toughness. In particular, the steel plate member of the invention has a tensile strength of 1200 MPa or higher.

Herein the steel plate member is not limited to be a single martensite phase. The martensite phase average grain diameter needs to be 5 μm or less in the area of the martensite phase. Note that the martensite phase average grain diameter is the average value of the grain sizes of the martensite phase.

Such a steel plate member contains 0.15 to 0.4 wt % of C, 1.0 to 5.0 wt % of Mn or of a total of Mn and at least one of Cr, Mo, Cu, and Ni, 0.02 to 2.0 wt % of at least any one of Si and Al, and the remainder being Fe and unavoidable impurities.

The steel plate member is heated to a highest peak temperature T° C. of 675 to 950° C. at a rate of temperature increase of 10° C./sec or higher, is kept at the highest peak temperature T° C. for (40-T/25) sec or less, and thereafter is subjected to cooling to not more than an Ms point, which is the temperature of formation of martensite phase, while pressing the steel plate member at a cooling rate of 1.0° C./sec or higher from the highest peak temperature T° C. to thereby generate a martensite phase.

In addition, the martensite phase average grain diameter can be 5 μm or less, and a steel material or a steel plate member having a high strength and high toughness whose tensile strength is 1200 MPa or higher can be provided. Furthermore, the martensite phase average grain diameter can be further reduced by containing at least one of B, Ti, Nb, and Zr by 0.1 wt % or less in the steel plate member.

Hereinafter, the detail will be described with reference to examples.

Example 1

First, by using a steel containing:
C: 0.22 wt %
Mn: 3.0 wt %
Si: 0.05 wt %
Al: 0.05 wt %
Ti: 0.02 wt %
B: 0.002 wt %
and the remainder being Fe and unavoidable impurities, plate-like steel plate members having a thickness of 1.4 mm were manufactured. The steel plate members were subjected to cold rolling at a reduction of 60%.

The steel plate members were respectively heated to the highest peak temperatures T's of 650° C., 700° C., 775° C., 850° C., 950° C., 1000° C. at the rate of temperature increase of 200° C./sec, kept at the respective highest peak temperatures T's for 0.1 sec, and then, cooled to not more than the Ms point, which is the temperature of formation of martensite phase, at the cooling rate of 10° C./sec. However, when the highest peak temperature T was 1000° C., the keeping time of the highest peak temperature T was 4 sec. The steel plate members were heated by means of electric heating, and cooled by means of natural cooling.

Furthermore, the steel plate members are subjected to press molding to be a hat form in a mid-flow of cooling from the highest peak temperatures T's to not more than the Ms point in the state where the temperatures are lowered by 100 to 150° C. from the highest peak temperatures T's, and furthermore, the steel plate members were punched in the state where the temperatures are lowered by 50 to 100° C.

After the steel plate members ware sufficiently cooled, test pieces were cut from respective vertex portions of the steel plate members having a hat form, and a tension test and a Charpy impact test were conducted. Note that three test pieces were overlapped when the Charpy impact test was performed.

The martensite phase average grain diameter, tensile strength, and transition temperature at each highest peak temperature T are shown in Table 1. Note that the transition temperature is a barometer of toughness, and the value becomes larger as the toughness becomes lower.

TABLE 1

| Experiment No. | Highest peak temperature (° C.) | Average grain diameter (μm) | Tensile strength (MPa) | Transition temperature (° C.) |
|---|---|---|---|---|
| 1 (comparative example) | 650 | 7.2 | 1254 | 20 |
| 2 (present invention) | 700 | 1.8 | 1522 | −60 |
| 3 (present invention) | 775 | 1.7 | 1580 | −70 |
| 4 (present invention) | 850 | 1.8 | 1543 | −70 |
| 5 (present invention) | 950 | 1.9 | 1535 | −60 |
| 6 (comparative example) | 1000 | 12.1 | 1525 | 10 |

As shown in Table 1, it is considered that the martensite phase is not sufficiently generated since reverse transformation to austenite phase does not fully occur, so that the average grain diameter of the structure is large and the transition temperature is also high when the highest peak temperature is 650° C.

On the other hand, the structure is coarsened and the transition temperature is high when the highest peak temperature is 1000° C. FIG. 1 is an SEM photo image taking a martensite phase in the case of Experiment No. 6.

Figure 2:
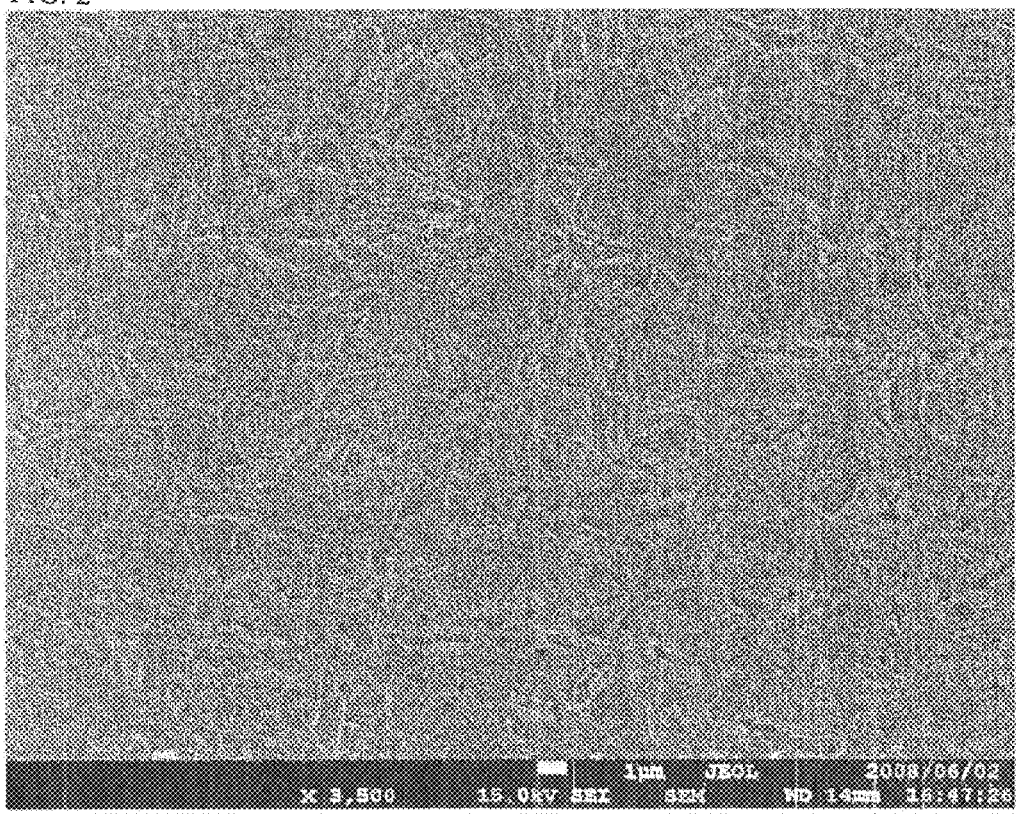
FIG. 2 is an SEM photo image taking a martensite phase of a steel plate member of Experiment No. 3 subjected to hot pressing of the invention.

It is considered that the preferable highest peak temperature T is from 675 to 950° C. from the experimental result. Note that an SEM photo image taking a martensite phase when heated to the highest peak temperature T of 775° C. at the rate of temperature increase of 200° C./sec, kept for 1.0 sec at the highest peak temperature T, and thereafter cooled to not more than the Ms point, which is the temperature of formation of martensite phase, at the cooling rate of 10° C./sec is shown in FIG. 2. In this case, the martensite phase average grain diameter was 1.7 μm, the tensile strength was 1532 MPa, and the transition temperature was −70° C.

Example 2

Using steel plate members having the structure described in Example 1, test pieces were manufactured similarly to Example 1 under the conditions that the highest peak temperature T is 800° C., the rates of temperature increase are 5° C./sec, 15° C./sec, 200° C./sec. Note that the test pieces were kept for 0.1 sec at the highest peak temperature T, and then cooled to not more than the Ms point, which is the temperature of formation of martensite phase, at the cooling rate of 10° C./sec.

The martensite phase average grain diameter, tensile strength, and transition temperature at each rate of temperature increase are shown in Table 2.

TABLE 2

| Experiment No. | Rate of temperature increase (° C./sec) | Average grain diameter (μm) | Tensile strength (MPa) | Transition temperature (° C.) |
|---|---|---|---|---|
| 7 (comparative example) | 5 | 6.0 | 1480 | 10 |
| 8 (comparative example) | 15 | 3.6 | 1520 | −50 |
| 9 (present invention | 200 | 1.8 | 1564 | −60 |

AS shown in Table 2, when the rate of temperature increase is 5° C./sec, the structure of the martensite phase is coarsened, and the transition temperature is high.

From the experimental result, the rate of temperature increase needs to be 10° C./sec or higher. On the other hand, from the result of Experiment No. 5 of Table 1, when the rate of temperature increase is 200° C./sec and the highest peak temperature is 950° C., the martensite phase average grain diameter is 1.9 μm. It is, therefore, preferable that the rate of temperature increase be 200° C./sec or higher in order to miniaturize the average grain diameter. Note that although the upper limit of the rate of temperature increase depends on the ability of a heating device for heating the steel plate members, high speed heating is readily available with a conductive heating device, so that heating at 200° C./sec or higher can be carried out without any problem.

Example 3

Using steel plate members having the structure described in Example 1, test pieces similar to those in Example 1 were manufactured under the conditions that the highest peak temperature T is 800° C., the rate of temperature increase is 200° C./sec, and the temperature keeping times at the highest peak temperature T are 0.1, 2.0, 12 sec. Note that the steel plate members were cooled to not more than the Ms point, which is the temperature of formation of martensite phase, at the cooling rate of 10° C./sec. The test piece for which the temperature keeping time was 0.1 sec is the test piece of Experiment No. 9 of the above-mentioned Example 2.

The martensite phase average grain diameter, tensile strength, and transition temperature at each temperature keeping time are shown in Table 3.

TABLE 3

| Experiment No. | Temperature keeping time (sec) | Average grain diameter (μm) | Tensile strength (MPa) | Transition temperature (° C.) |
|---|---|---|---|---|
| 9 (present invention) | 0.1 | 1.8 | 1564 | −60 |
| 10 (present invention) | 2.0 | 1.8 | 1521 | −60 |
| 11 (comparative example) | 12 | 5.2 | 1518 | −10 |

As shown in Table 3, when the temperature keeping time is lengthened to 12 sec, the structure is coarsened and the transition temperature is high. That is, it is preferable that the temperature keeping time be as short as possible.

In particular, it is found that it is preferable that the higher the temperature of the highest peak temperature T, the shorter the temperature keeping time, and the temperature keeping time be (40-T/25) sec or less.

That is, it is preferable that the temperature keeping time be (40-T/25) sec or less with respect to the highest peak temperature T. If the steel plate member cannot be cooled right after heated due to the formation of the device, it is preferable that the highest peak temperature T be set as low as possible within 675 to 950° C. to provide a margin.

Example 4

Using the steel plate members having the structure described in Example 1, test pieces similar to those in Example 1 were manufactured under the conditions that the highest peak temperature T is 800° C., the rate of temperature increase is 200° C./sec, the temperature keeping time at the highest peak temperature T is 0.1 sec, and the steel plate members are cooled to not more than the Ms point at the cooling rate of 0.5° C./sec, 10° C./sec, and 80° C./sec, respectively. Note that the test piece for which the cooling rate was 10° C./sec is the test piece of Experiment No. 9 of the above-mentioned Example 2.

The martensite phase average grain diameter, tensile strength, and transition temperature at each cooling rate are shown in Table 4.

TABLE 4

| Experiment No. | Cooling rate (° C./sec) | Average grain diameter (μm) | Tensile strength (MPa) | Transition temperature (° C.) |
|---|---|---|---|---|
| 9 (present invention) | 10 | 1.8 | 1564 | −60 |
| 12 (comparative example) | 0.5 | 7.8 | 1030 | 10 |
| 13 (present invention) | 80 | 1.6 | 1567 | −80 |

As shown in Table 4, when the cooling rate is lowered to 0.5° C./sec, the structure is coarsened and the transition temperature is high. That is, it is preferable that the cooling rate be as fast as possible. In order to increase the cooling rate, the steel plate member may be cooled by using a coolant such as water.

However, when the cooling rate is too fast, press working for forming the steel plate member to have a predetermined shape may not be ended before reaching the Ms point, so that about 1.0 to 100° C./sec is preferable. Note that, if possible, the cooling rate may be 100° C./sec or higher.

Since deterioration of shape fixability and deterioration of delayed fracture resistance easily occur when the steel plate member is subjected to the press working at not more than the Ms point, it is preferable to determine the cooling rate in consideration of the time required for the press working.

The press working may be performed by one step, and also may be by plurality of steps as long as the temperature of the steel plate member does not reach the Ms point. Excellent shape fixability can be obtained by performing the press working at a temperature higher than the Ms point.

Example 5

Although the steel plate member having the structure of the above-mentioned Example 1 was subjected to cold rolling at a reduction of 60% to have the thickness of 1.4 mm, test pieces were manufactured in the case of performing no cold rolling, that is, a reduction of 0%, and increasing the thickness of the steel plate member. Note that when the test pieces were manufactured, the highest peak temperature T was 800° C., the rate of temperature increase was 200° C./sec, and the temperature keeping time at the highest peak temperature T was 0.1 sec. Furthermore, the cooling rate was 3° C./sec for the test piece having a thickness of 1.4 mm at a reduction of 0%, and was 10° C./sec for the test piece having a thickness of 4.2 mm at a reduction of 0%.

The martensite phase average grain diameter, tensile strength, and transition temperature at each of the above-mentioned test pieces are shown in Table 5.

TABLE 5

| Experiment No. | Thickness (mm) | Cooling rate (° C./sec) | Reduction (%) | Average grain diameter (μm) | Tensile strength (MPa) | Transition temperature (° C.) |
|---|---|---|---|---|---|---|
| 14 (comparative example) | 1.4 | 3 | 0 | 3.0 | 1533 | −50 |
| 15 (comparative example) | 4.2 | 10 | 0 | 3.2 | 1524 | −30 |

In this manner, it is understood that the martensite phase is miniaturized and the toughness is increased in the steel plate member even when no cold rolling is performed.

When no cold rolling is performed, the martensite phase average grain diameter is about 3.0 μm. However, as shown in Examples 1 to 4, the average grain diameter becomes about 2.0 μm by performing cold rolling at a reduction of 60%, so that toughness can be improved by the cold rolling.

Note that, in order to obtain the martensite phase whose average grain diameter is about 2.0 μm, cold rolling at a reduction of 30% is necessary. The upper limit of the reduction is about 95% since miniaturization effect becomes saturated state in a high reduction area and working cost of the cold rolling is increased.

Furthermore, it is preferable that the thickness of the steel plate member be up to about 5.0 mm in order to execute rapid heating at a rate of temperature increase of 50° C./sec or higher as uniform as possible. However, a steel plate member having a larger thickness may be used as far as uniform heating is possible.

Note that when the thickness of the steel plate member is reduced to less than 0.1 mm, deformation may occur during rapid heating at a rate of temperature increase of 50° C./sec or higher. Accordingly, it is preferable that the lower limit be 0.1 mm or to use an auxiliary jig or the like for preventing deformation caused by heating.

Example 6

Using steel grads of ingredients shown below in Table 6, plate-like steel plate members whose thickness is 1.4 mm were manufactured. The highest peak temperature T was 800° C., the rate of temperature increase was 200° C./sec, the temperature keeping time at the highest peak temperature T was 0.1 sec for the steel plate members, and the steel plate members were cooled at a predetermined cooling rate to not more than the Ms point while pressing the steel plate members to manufacture test pieces similar to those in Example 1.

TABLE 6

| Steel grade | C | Si | Mn | Cr | Mo | Ni | Cu | Al | Ti | Nb | Zr | B |
|---|---|---|---|---|---|---|---|---|---|---|---|---|
| A | 0.22 | 0.23 | 1.5 | | | | | 0.05 | 0.02 | | | 0.0020 |
| B | 0.25 | 0.11 | 3.0 | | | | | 0.05 | | | | |
| C | 0.15 | 0.34 | 3.0 | | | | | 0.05 | 0.02 | 0.02 | | 0.0020 |
| D | 0.35 | 0.24 | 3.0 | | | | | 1.51 | | | | |
| E | 0.50 | 0.30 | 1.2 | | | | | 0.05 | | | | |
| F | 0.18 | 1.41 | 2.2 | | | | | 0.04 | | | 0.03 | 0.0018 |
| G | 0.10 | 0.08 | 2.2 | | | | | 0.06 | 0.02 | | | 0.0022 |
| H | 0.20 | 0.35 | 6.2 | | | | | 0.05 | 0.02 | | | 0.0020 |
| I | 0.22 | 0.20 | 0.8 | 2.5 | | | | 0.05 | 0.02 | | | 0.0025 |
| J | 0.21 | 0.21 | 0.5 | | 1.5 | | | 0.06 | 0.02 | | | 0.0021 |
| K | 0.23 | 0.24 | 0.7 | | | 0.7 | 1.5 | 0.04 | 0.03 | | | 0.0024 |
| L | 0.22 | 0.26 | 0.5 | 0.5 | 0.2 | 0.5 | | 0.05 | 0.03 | | | 0.0026 |

Note that the unit of the ingredients is wt %, and the remainder is Fe and unavoidable impurities.

The martensite phase average grain diameter, the tensile strength, and transition temperature of the test piece of each steel grade A to L are shown in Table 7.

TABLE 7

| Experiment No. | Steel grade | Cooling rate (° C./sec) | Reduction (%) | Average grain diameter (μm) | Tensile strength (MPa) | Transition temperature (° C.) |
|---|---|---|---|---|---|---|
| 16 (present invention) | A | 35 | 60 | 1.8 | 1527 | −60 |
| 17 (comparative example) | | 10 | 0 | 2.6 | 1515 | −50 |
| 18 (present invention) | B | 10 | 60 | 1.8 | 1640 | −30 |
| 19 (comparative example) | | 10 | 0 | 2.5 | 1622 | −25 |
| 20 (present invention) | C | 10 | 60 | 1.2 | 1280 | −50 |
| 21 (comparative example) | | 10 | 0 | 2.0 | 1263 | −40 |
| 22 (present invention) | D | 10 | 60 | 1.7 | 1805 | −30 |
| 23 (comparative example) | | 10 | 0 | 2.8 | 1777 | −30 |

TABLE 7-continued

| Experiment No. | Steel grade | Cooling rate (° C./sec) | Reduction (%) | Average grain diameter (μm) | Tensile strength (MPa) | Transition temperature (° C.) |
|---|---|---|---|---|---|---|
| 24 (comparative example) | E | 10 | 60 | 2.4 | 2043 | 50 |
| 25 (comparative example) | | 30 | 0 | 5.2 | 2003 | 40 |
| 26 (present invention) | F | 25 | 60 | 1.9 | 1466 | −50 |
| 27 (comparative example) | | 30 | 0 | 2.9 | 1423 | −40 |
| 28 (comparative example) | G | 10 | 60 | 6.3 | 887 | −30 |
| 29 (comparative example) | | 30 | 0 | 7.7 | 876 | −30 |
| 30 (comparative example) | H | 10 | 60 | 1.9 | 1564 | 40 |
| 31 (comparative example) | | 30 | 0 | 3.6 | 1525 | 40 |
| 32 (present invention) | I | 10 | 60 | 1.8 | 1525 | −60 |
| 33 (present invention) | J | 10 | 60 | 1.6 | 1591 | 70 |
| 34 (present invention) | K | 10 | 60 | 1.8 | 1533 | −70 |
| 35 (present invention) | L | 10 | 60 | 1.9 | 1585 | −60 |

As shown in table 7, in the case of steel grade E in which much C (0.50 wt %) is contained, the transition temperature is high, and in contrast, in the case of steel grade G in which less C (0.10 wt %) is contained, the average grain diameter of martensite particles is coarsened. Furthermore, in the case of steel grade H in which much Mn (6.2 wt %) is contained, the transition temperature is high.

From this, it is preferable that the steel plate member contain 0.15 to 0.4 wt % of C, 1.0 to 5.0 wt % of Mn, 0.02 to 2.0 wt % of at least any one of Si and Al, and the remaining being Fe and unavoidable impurities.

Note that as shown for steel grades I to L, usage of Mn may be restrained by using at least one of Cr, Mo, Cu, Ni as a substitute of some of Mn, and the total content of Mn and at least one of Cr, Mo, Cu, Ni may be 1.0 to 5.0 wt %.

Furthermore, generation of a void in the steel can be restrained by reducing dissolved oxygen by adding Si or Al by 0.02 wt % or more. On the other hand, when added by 0.2 wt % or more, the martensite phase average grain diameter is coarsened, so that 0.02 to 2.0 wt % is preferable.

Furthermore, it is preferable to contain at least one of B, Ti, Nb, and Zr in order to miniaturize the martensite phase, and in particular, when added by 0.1 wt % or more, a miniaturization effect becomes saturated state, so that 0.1 wt % or less is preferable.

By providing a plating film whose thickness is 0.1 to 20 μm as a protecting layer on the steel plate member, generation of scale on a surface of the steel plate member can be prevented.

An electro plated film of Ni, an electro plated film of Cr, a hot dip galvanizing film, a molten aluminum plating film, or the like may be used for the plating film. The plating film may have a required thickness as needed. Note that the plating film may be 20 μm or higher. However, since a protection effect by the plating film becomes saturated state, 20 μm or less is a sufficient thickness.

As described above, the steel plate member contains, with respect to the chemical composition of the steel plate, 0.15 to 0.4 wt % of C, 1.0 to 5.0 wt % of Mn or of a total of Mn and at least one of Cr, Mo, Cu, and Ni, 0.02 to 2.0 wt % of at least any one of Si and Al, and the remainder being Fe and unavoidable impurities, and the steel plate member is subjected to hot pressing by heating the steel plate member to the highest heating temperature T of 675 to 950° C. at the rate of temperature increase of 10° C./sec, keeping at the highest heating temperature T for (40-T/25) sec, and then, cooling to not more than the Ms point, which is the temperature of formation of martensite phase, at the cooling rate of 1.0° C./sec or higher from the highest heating temperature T while pressing the steel plate member. Herewith, the hot plate member having a fine structure in which the average grain diameter of martensite particles is 5 μm or less can be provided and the tensile strength can be 1200 MPa or higher as physical properties.

Furthermore, by subjecting the steel plate member to cold pressing at a reduction of 30% or higher in advance, the steel plate member or the steel material having a fine structure in which the average grain diameter of martensite particles is 2 μm or less can be provided, and the tensile strength can be 1500 MPa or higher.

In addition, since the cooling rate can be reduced to 1.0° C./sec or higher, molding the steel plate member or the steel material into a predetermined shape by press working can be executed before reaching the Ms point, so that the steel plate member or the steel material having high strength and high toughness can be manufactured without losing productivity.

The invention claimed is:

1. A manufacturing method of a hot-pressed steel plate member using a raw steel plate comprising, with respect to the chemical composition of the steel plate, 0.15 to 0.4 wt % of C, 1.0 to 5.0 wt % of Mn or of a total of Mn and at least one of Cr, Mo, Cu, and Ni, 0.02 to 2.0 wt % of at least any one of Si and Al, and the remainder being Fe and unavoidable impurities, and providing physical properties of a martensite phase average grain diameter of 2 μm or less and a tensile strength of 1200 MPa or higher by being subjected to hot pressing, the hot pressing comprising:

a heating process for heating the steel plate member to a highest heating temperature T° C. of 675 to 950° C. at a rate of temperature increase of 200° C./sec or higher;

a temperature keeping process for keeping the highest heating temperature T° C. for (40-T/25) sec or less; and a cooling and pressing process for cooling the steel plate member to not more than an Ms point that is a temperature of formation of the martensite phase at a cooling rate of 1.0° C./sec or higher from the highest heating temperature T° C. while pressing the steel plate member, wherein the steel plate member is subjected to cold rolling at a reduction of 30% or higher before the heating process.

2. The manufacturing method of a hot-pressed steel plate member according to claim 1, wherein the steel plate member contains 0.1 wt % or less of at least one of B, Ti, Nb, and Zr.

3. The manufacturing method of a hot-pressed steel plate member according to claim 1, wherein press working for forming the steel plate member to have a shape is performed once or more before reaching the Ms point in the cooling process.

* * * * *